US009138858B2

(12) United States Patent
Benvegnu et al.

(10) Patent No.: US 9,138,858 B2
(45) Date of Patent: Sep. 22, 2015

(54) THIN POLISHING PAD WITH WINDOW AND MOLDING PROCESS

(71) Applicant: Applied Materials, Inc., Santa Clara, CA (US)

(72) Inventors: Dominic J. Benvegnu, La Honda, CA (US); Jimin Zhang, San Jose, CA (US); Thomas H. Osterheld, Mountain View, CA (US); Boguslaw A. Swedek, Cupertino, CA (US)

(73) Assignee: Applied Materials, Inc., Santa Clara, CA (US)

( * ) Notice: Subject to any disclaimer, the term of this patent is extended or adjusted under 35 U.S.C. 154(b) by 0 days.

(21) Appl. No.: 13/948,547

(22) Filed: Jul. 23, 2013

(65) Prior Publication Data

US 2013/0309951 A1 Nov. 21, 2013

Related U.S. Application Data

(62) Division of application No. 12/130,670, filed on May 30, 2008, now Pat. No. 8,562,389.

(60) Provisional application No. 60/942,956, filed on Jun. 8, 2007.

(51) Int. Cl.
*B24B 37/26* (2012.01)
*B24B 49/12* (2006.01)
(Continued)

(52) U.S. Cl.
CPC ..... *B24B 37/205* (2013.01); *B24B 37/013* (2013.01)

(58) Field of Classification Search
CPC ..... B24B 49/12; B24B 37/16; B24B 37/26; B24B 37/205; B24D 11/00
USPC ..... 451/6, 41, 285, 287, 526, 529, 530, 451/533, 538; 51/295, 297, 298; 264/263
See application file for complete search history.

(56) References Cited

U.S. PATENT DOCUMENTS 6,146,242 A 11/2000 Treur et al.
6,171,181 B1 * 1/2001 Roberts et al. ..... 451/527
(Continued)

FOREIGN PATENT DOCUMENTS

EP 1470892 10/2004
JP 2003-163191 6/2003
(Continued)

OTHER PUBLICATIONS

International Search Report and the Written Opinion for International Application No. PCT/US2008/065316, mailed Dec. 22, 2008, 15 pages.
(Continued)

*Primary Examiner* — Eileen Morgan
(74) *Attorney, Agent, or Firm* — Fish & Richardson P.C.

(57) ABSTRACT

A polishing pad is described that has a polishing layer with a polishing surface, an adhesive layer on a side of the polishing layer opposite the polishing layer, and a solid light-transmitting window extending through and molded to the polishing layer. The window has a top surface coplanar with the polishing surface and a bottom surface coplanar with a lower surface of the adhesive layer. A method of making a polishing pad includes forming an aperture through a polishing layer and an adhesive layer, securing a backing piece to the adhesive layer on a side opposite a polishing surface of the polishing layer, dispensing a liquid polymer into the aperture, and curing the liquid polymer to form a window.

10 Claims, 3 Drawing Sheets

(51) Int. Cl.
*B24B 37/20* (2012.01)
*B24B 37/013* (2012.01)

(56) References Cited

U.S. PATENT DOCUMENTS

| | | | | |
|---|---|---|---|---|
| 6,254,459 | B1 * | 7/2001 | Bajaj et al. | 451/41 |
| 6,358,130 | B1 * | 3/2002 | Freeman et al. | 451/285 |
| 6,458,014 | B1 * | 10/2002 | Ihsikawa et al. | 451/6 |
| 6,599,765 | B1 * | 7/2003 | Boyd et al. | 438/16 |
| 6,685,537 | B1 * | 2/2004 | Fruitman et al. | 451/6 |
| 6,806,100 | B1 * | 10/2004 | Xu et al. | 438/8 |
| 7,179,151 | B1 * | 2/2007 | Bottema et al. | 451/6 |
| 7,195,539 | B2 * | 3/2007 | Turner et al. | 451/6 |
| 7,323,415 | B2 * | 1/2008 | Shiho et al. | 438/691 |
| 7,654,885 | B2 * | 2/2010 | Tsai et al. | 451/288 |
| 8,393,940 | B2 * | 3/2013 | Swedek et al. | 451/527 |
| 2002/0137431 | A1 * | 9/2002 | Labunsky et al. | 451/6 |
| 2003/0109209 | A1 | 6/2003 | Hishiki | |
| 2003/0153253 | A1 * | 8/2003 | Hanamoto et al. | 451/296 |
| 2005/0060943 | A1 * | 3/2005 | Turner et al. | 51/297 |
| 2005/0191945 | A1 * | 9/2005 | Petroski et al. | 451/6 |
| 2005/0221723 | A1 * | 10/2005 | Duboust et al. | 451/41 |
| 2006/0037699 | A1 | 2/2006 | Nakamori et al. | |
| 2006/0128271 | A1 * | 6/2006 | Shiho et al. | 451/6 |
| 2006/0197249 | A1 | 9/2006 | Shih et al. | |
| 2008/0305729 | A1 * | 12/2008 | Benvegnu et al. | 451/530 |
| 2010/0267318 | A1 * | 10/2010 | Duboust et al. | 451/533 |

FOREIGN PATENT DOCUMENTS

| | | |
|---|---|---|
| JP | 2005-32849 | 2/2005 |
| JP | 2007-118106 | 5/2007 |
| TW | 200408494 | 6/2004 |
| TW | I220405 | 8/2004 |
| TW | I285579 | 8/2007 |
| TW | I325800 | 6/2010 |

OTHER PUBLICATIONS

Office Action dated Oct. 30, 2012 for Japanese Application No. 2010-511259, 2 pages.
Taiwan Search Report for Application No. 097120628, dated Nov. 13, 2013, 1 page.

* cited by examiner

THIN POLISHING PAD WITH WINDOW AND MOLDING PROCESS

CROSS-REFERENCE TO RELATED APPLICATIONS

This application is a divisional of U.S. application Ser. No. 12/130,670, filed May 30, 2008, which claims priority to U.S. Provisional Application Ser. No. 60/942,956, filed on Jun. 8, 2007.

TECHNICAL FIELD

A polishing pad with a window, a system containing such a polishing pad, and a process for making and using such a polishing pad are described.

BACKGROUND

In the process of fabricating modern semiconductor integrated circuits (IC), it is often necessary planarize the outer surface of the substrate. For example, planarization may be needed to polish away a conductive filler layer until the top surface of an underlying layer is exposed, leaving the conductive material between the raised pattern of the insulative layer to form vias, plugs and lines that provide conductive paths between thin film circuits on the substrate. In addition, planarization may be needed to flatten and thin an oxide layer to provide a flat surface suitable for photolithography.

One method for achieving semiconductor substrate planarization or topography removal is chemical mechanical polishing (CMP). A conventional chemical mechanical polishing (CMP) process involves pressing a substrate against a rotating polishing pad in the presence of an abrasive slurry.

In general, there is a need to detect when the desired surface planarity or layer thickness has been reached or when an underlying layer has been exposed in order to determine whether to stop polishing. Several techniques have been developed for the in-situ detection of endpoints during the CMP process. For example, an optical monitoring system for in-situ measuring of uniformity of a layer on a substrate during polishing of the layer has been employed. The optical monitoring system can include a light source that directs a light beam toward the substrate during polishing, a detector that measures light reflected from the substrate, and a computer that analyzes a signal from the detector and calculates whether the endpoint has been detected. In some CMP systems, the light beam is directed toward the substrate through a window in the polishing pad.

SUMMARY

In one aspect, a polishing pad is described that has a polishing layer with a polishing surface, an adhesive layer on a side of the polishing layer opposite the polishing layer, and a solid light-transmitting window extending through and molded to the polishing layer. The window has a top surface coplanar with the polishing surface and a bottom surface coplanar with a lower surface of the adhesive layer.

Implementations of the invention may include one or more of the following. The polishing layer may be a single layer. A removable liner may span the adhesive layer. The liner may have a hole aligned with the window. A removable window backing piece may be positioned in the hole in the liner and may abut the window. There may be grooves in the polishing surface, and a portion of the window may project into and be molded to the grooves. The perimeter of the window may follow a roughened path. The polishing pad may be circular, the window may extend along a radius of the polishing pad, and the window is longer along the radius than along a direction normal to the radius. The polishing pad may have a total thickness less than 1 mm.

In another aspect, a method of making a polishing pad is described. The method includes forming an aperture through a polishing layer and an adhesive layer, securing a backing piece to the adhesive layer on a side opposite a polishing surface of the polishing layer, dispensing a liquid polymer into the aperture, and curing the liquid polymer to form a window.

Implementations of the invention may include one or more of the following. A hole may be formed in a removable liner, and securing the backing piece may include installing the backing piece in the hole. A portion of the window may project above the polishing surface. The liquid polymer may flows into grooves in the polishing surface. The polishing layer may be a single layer. The aperture may be formed by stamping the polishing pad or cutting the polishing pad. A perimeter of the window may follow a roughened path. The polishing pad may be circular, the window may extend along a radius of the polishing pad, and the window is longer along the radius than along a direction normal to the radius. The polishing pad may have a total thickness less than 1 mm.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1:
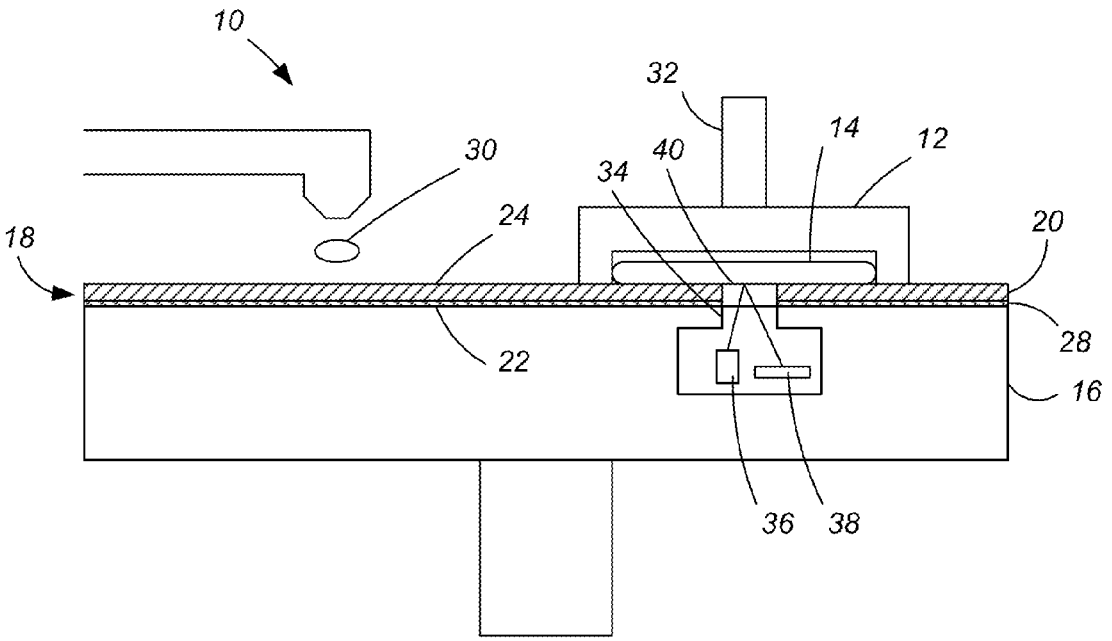
FIG. 1 is a cross-sectional view of a CMP apparatus containing a polishing pad.

As shown in FIG. 1, the CMP apparatus 10 includes a polishing head 12 for holding a semiconductor substrate 14 against a polishing pad 18 on a platen 16. The CMP apparatus may be constructed as described in U.S. Pat. No. 5,738,574, the entire disclosure of which is incorporated herein by reference.

The substrate can be, for example, a product substrate (e.g., which includes multiple memory or processor dies), a test substrate, a bare substrate, and a gating substrate. The substrate can be at various stages of integrated circuit fabrication, e.g., the substrate can be a bare wafer, or it can include one or more deposited and/or patterned layers. The term substrate can include circular disks and rectangular sheets.

The effective portion of the polishing pad 18 can include a polishing layer 20 with a polishing surface 24 to contact the substrate and a bottom surface 22 to secured to the platen 16 by an adhesive 28. The polishing pad can be a single-layer pad with the polishing layer 20 formed of a thin durable material suitable for a chemical mechanical polishing process. Such a polishing pad is available under the trade name H7000HN from Fujibo in Tokyo, Japan.

Figure 2:
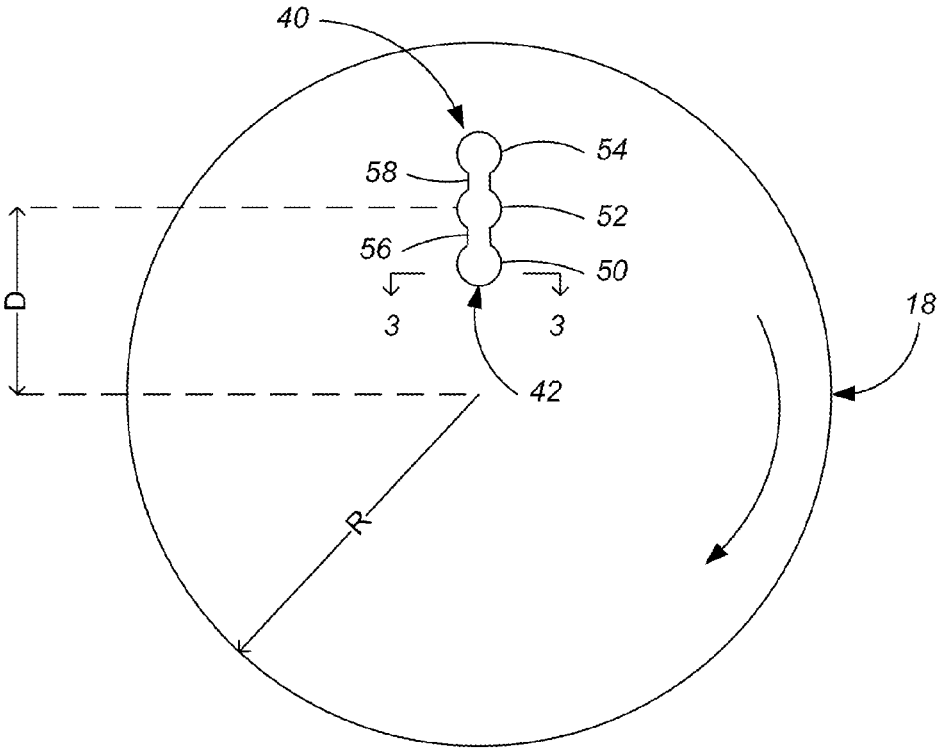
FIG. 2 is a top view of an embodiment of a polishing pad with a window.

Referring to FIG. 2, in some implementations the polishing pad 18 has a radius R of 15.0 inches (381.00 mm), with a corresponding diameter of 30 inches. In other implementations, the polishing pad 18 can have a radius of 15.25 inches (387.35 mm) or 15.5 inches (393.70 mm), with corresponding diameter of 30.5 inches or 31 inches.

Figure 3:
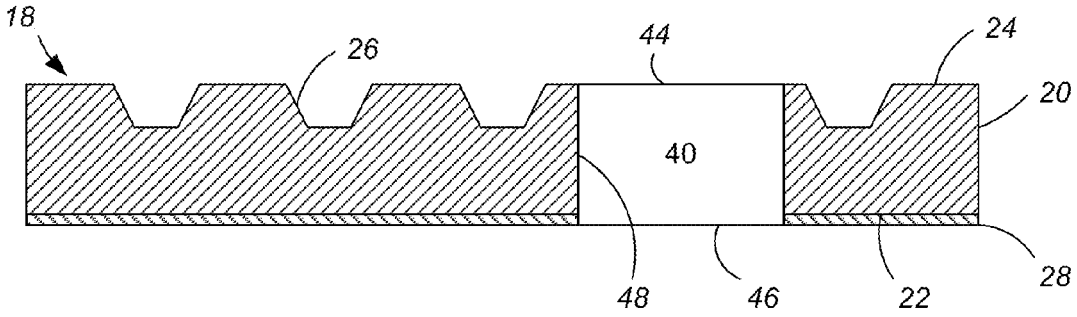
FIG. 3 is a cross-sectional view of the polishing pad of FIG. 2.

Referring to FIG. 3, in some implementations, grooves 26 can be formed in the polishing surface 24. The grooves can be in a "waffle" pattern, e.g., a cross-hatched pattern of perpendicular grooves with sloped side walls that divide the polishing surface into rectangular, e.g., square, areas.

Returning to FIG. 1, typically the polishing pad material is wetted with the chemical polishing liquid 30, which can include abrasive particles. For example, the slurry can include KOH (potassium hydroxide) and fumed-silica particles. However, some polishing processes are "abrasive-free".

The polishing head 12 applies pressure to the substrate 14 against the polishing pad 18 as the platen rotates about its central axis. In addition, the polishing head 12 is usually rotated about its central axis, and translated across the surface of the platen 16 via a drive shaft or translation arm 32. The pressure and relative motion between the substrate and the polishing surface, in conjunction with the polishing solution, result in polishing of the substrate.

An optical aperture 34 is formed in the top surface of the platen 16. An optical monitoring system, including a light source 36, such as a laser, and a detector 38, such as a photodetector, can be located below the top surface of the platen 16. For example, the optical monitoring system can be located in a chamber inside the platen 16 that is in optical communication with the optical aperture 34, and can rotate with the platen. The optical aperture 34 can be filled with a transparent solid piece, such as a quartz block, or it can be an empty hole. In one implementation, the optical monitoring system and optical aperture are be formed as part of a module that fits into a corresponding recess in the platen. Alternatively, the optical monitoring system could be a stationary system located below the platen, and the optical aperture could extend through the platen. The light source can employ a wavelength anywhere from the far infrared to ultraviolet, such as red light, although a broadband spectrum, e.g., white light, can also be used, and the detector can be a spectrometer.

A window 40 is formed in the overlying polishing pad 18 and aligned with the optical aperture 34 in the platen. The window 40 and aperture 34 can be positioned such that they have a view of the substrate 14 held by the polishing head 12 during at least a portion of the platen's rotation, regardless of the translational position of the head 12. The light source 36 projects a light beam through the aperture 34 and the window 40 to impinge the surface of the overlying substrate 14 at least during a time when the window 40 is adjacent the substrate 14. Light reflected from the substrate forms a resultant beam that is detected by the detector 38. The light source and the detector are coupled to an unillustrated computer that receives the measured light intensity from the detector and uses it to determine the polishing endpoint, e.g., by detecting a sudden change in the reflectivity of the substrate that indicates the exposure of a new layer, by calculating the thickness removed from of the outer layer (such as a transparent oxide layer) using interferometric principles, or by monitoring the signal for predetermined endpoint criteria.

One problem with placement of a normal large rectangular window (e.g., a 2.25 by 0.75 inch window) into a very thin polishing layer is delamination during polishing. In particular, the lateral frictional force from the substrate during polishing can be greater than the adhesive force of the molding of the window to the sidewall of the pad.

Returning to FIG. 2, the window 40 is thin along the direction of the frictional force applied by the substrate during polishing (tangential to a radius in the case of a rotating a polishing pad) and wide in the direction perpendicular direction (along a radius in the case of a rotating a polishing pad). For example, the window 40 can use an area about 4 mm wide and 9.5 mm long centered a distance D of about 7.5 inches (190.50 mm) from the center of the polishing pad 18.

The window 40 can have an approximately rectangular shape with its longer dimension substantially parallel to the radius of the polishing pad that passes through the center of the window. However, the window 40 can have a ragged perimeter 42, e.g., the perimeter can be longer than a perimeter of a similarly shaped rectangle. This increases the surface area for contact of the window to the sidewall of the polishing pad, and can thereby improve adhesion of the window to the polishing pad. In some implementations, the window 40 includes three generally circular portions 50, 52 and 54, with the center circular portion 52 connected to the outer circular portions 50 and 54 by linear segments 56 and 58, respective. Each circular portion can have about the same diameter, and the linear segments can be narrower than the diameter of the circular portions. Each circular portion 50, 52 and 54 can have a diameter of about 4 mm.

Referring to FIG. 3, the window 40 is as deep as the combination of the polishing layer 20 and the adhesive layer 28, so that a top surface 44 of the window 40 is coplanar with the polishing surface 24 and a bottom surface 46 of the window is coplanar with a bottom surface of the adhesive layer 28. The perimeter of the window 40 can be secured, e.g., molded, to the inner sidewall edges 48 of the polishing layer 20.

Figure 4:
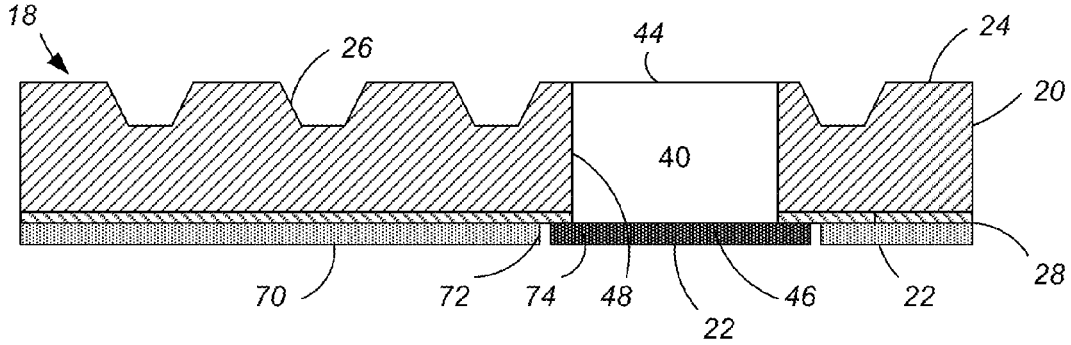
FIGS. 4-9 illustrate a method of forming a polishing pad.

Referring to FIG. 4, before installation on a platen, the polishing pad 18 can also include a liner 70 that spans the adhesive layer 28 on the bottom surface 22 of the polishing pad. The liner can be an incompressible and generally fluid-impermeable layer, for example, polyethylene terephthalate (PET), e.g., Mylar™. In use, the liner is manually peeled from the polishing pad, and the polishing layer 20 is applied to the platen with the pressure sensitive adhesive 28. The liner, however, does not span the window 40, but is removed in and immediately around the region of the window 40 to form a hole 72.

The polishing pad 40 is very thin, e.g., less than 2 mm, e.g., less than 1 mm. For example, the total thickness of the polishing layer 20, adhesive 28 and liner 70 can be about 0.9 mm. The polishing layer 20 can be about 0.8 mm thick, with the adhesive 28 and the liner 70 providing the remaining 0.1 mm. The grooves 26 can be about half the depth of the polishing pad, e.g., roughly 0.5 mm.

In addition to the liner 70, an optional window backing piece 74 can be span the window 40 and be secured to a portion of the pressure sensitive adhesive 28 immediately around the window 40. The window backing piece 74 can be slightly smaller than the hole 72 so the backing piece is separated from the liner 70 by a gap. The gap can have a width of, for example, a couple millimeters, e.g., 2 mm. The hole 72 and the backing piece 74 can cover an area about twice the maximum dimension of the window 40. For example, the hole can be a circular area about 24 mm diameter, and the backing piece 72 can be a disk of about 20 mm diameter. The backing piece 72 can be the same thickness as the liner 70, or thinner than the liner 70. The backing piece 72 can be polytetrafluoroethylene (PTFE), or another non-stick material.

Figure 5:
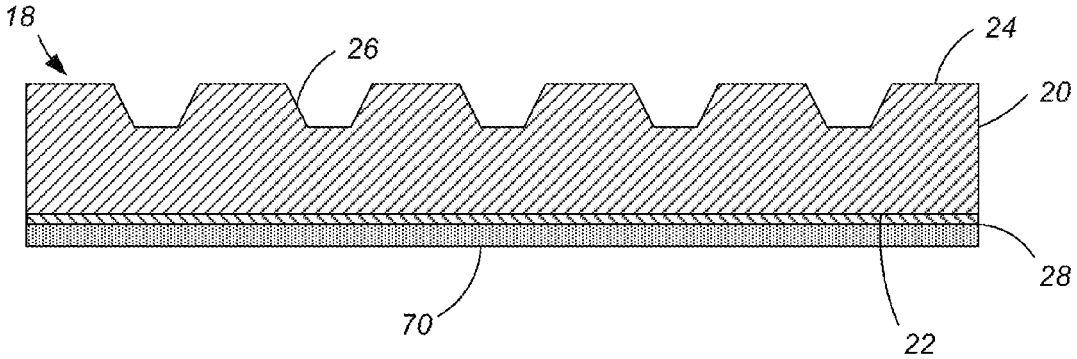

To manufacture the polishing pad, initially the polishing layer 20 is formed and the bottom surface of the polishing layer 20 is covered with the pressure sensitive adhesive 28 and a liner layer 70, as shown by FIG. 5. Grooves 26 can be formed in the polishing layer 20 as part of a pad molding process before attachment of the pressure sensitive adhesive 28 and a liner layer 70, or cut into the polishing layer 20 after the pad is formed and after the liner is attached.

Figure 6:
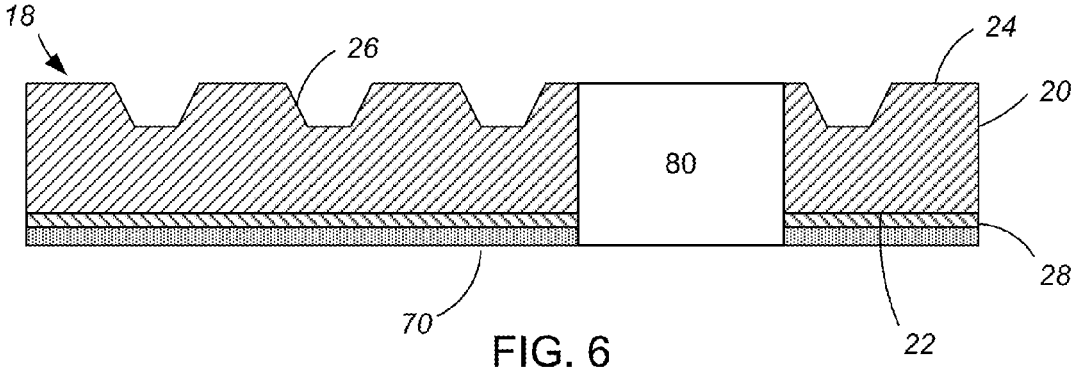

An aperture 80 is formed through the entire pad, including the polishing layer 20, the adhesive 28 and the liner 70, as shown by FIG. 6. In particular, to form the window shape shown in FIG. 2, three separate holes, e.g., of four mm diameter, can be punched through the pad. Then channels are cut between the holes to form a continuous aperture having a "dumbbell" shape.

Figure 7:
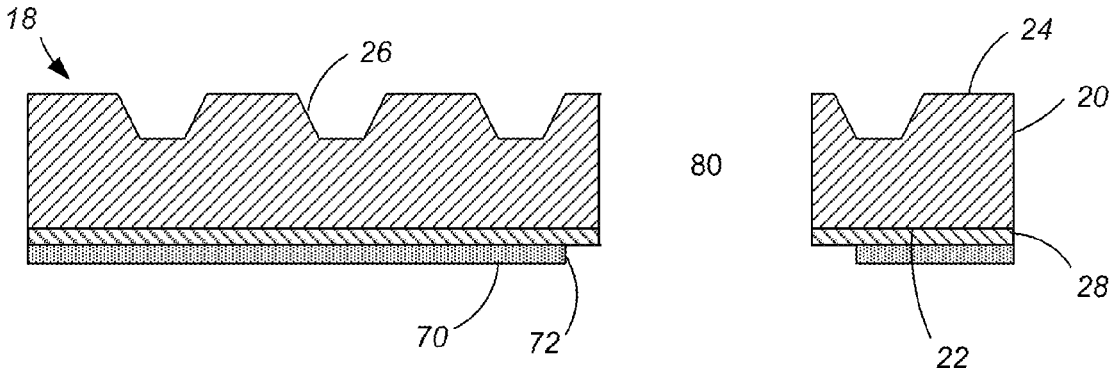

A portion of the liner 70 is removed from the region around the aperture 80 to form the hole 72 in the liner 70, as shown in FIG. 7. For example, the liner 70 can be peeled of the polishing pad entirely, a hole can be punched through the liner around the aperture 80, and the liner 70 can be placed back on the polishing layer 20 with the hole 72 aligned with the aperture 80. Alternatively, the hole 72 could be punched in the liner 70 before or during initial assembly of the polishing pad.

Figure 8:
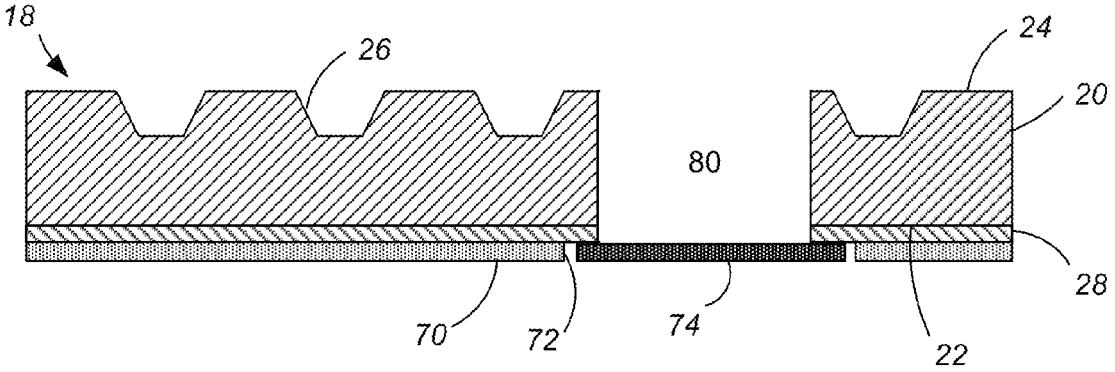

The window backing piece 74, such as a Teflon™ disk, is then installed in the hole 72 with the edges of the window backing piece 74 abutting the adhesive 28, as shown in FIG. 8. The window backing piece should be cleaned, e.g., wiped with ethanol. The window backing piece 74 will serve as the bottom of the mold for the window.

Figure 9:
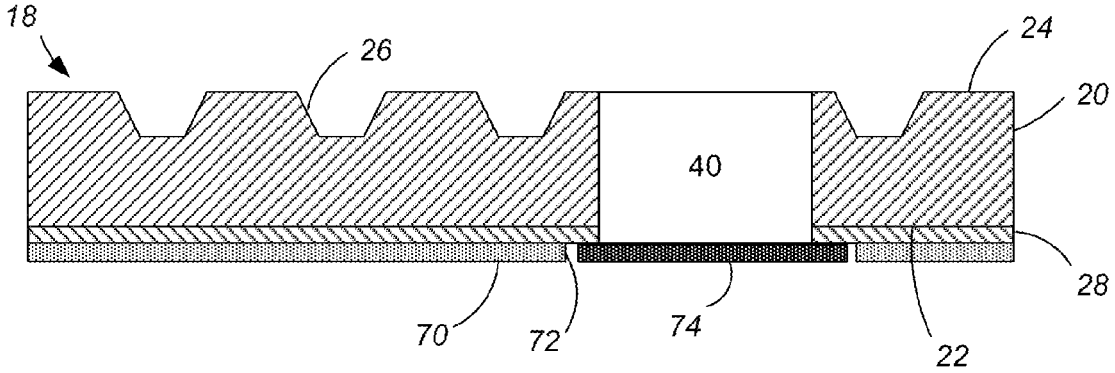

A liquid polymer is prepared and transferred into the aperture 80, and then cured to form the window 40, as shown in FIG. 9. The polymer can be polyurethane, and can be formed from a mixture of several components. In one implementation, the polymer is a mixture of 2 parts Calthane A 2300 and 3 parts Calthane B 2300 (available from Cal Polymers, Inc. of Long Beach, Calif.). The liquid polymer mixture can be degassed, e.g., for 15-30 minutes, before being placed into the aperture. The polymer can be cured at room temperature for about 24 hours, or a heat lamp or oven can be used to decrease cure time. If the cured window 40 projects above the polishing surface then the window can be leveled to be coplanar with the polishing surface, e.g., by abrasion with a diamond conditioning disk.

The window backing piece 74 can be removed from the aperture 72 by the manufacturer after the cure is complete before shipment of the pad to the customer, or the customer can remove the window backing piece before installation of the polishing pad on the platen.

If the grooves 24 intersect the aperture 80, then when the liquid polymer is transferred into the aperture, a portion of the liquid polymer can flow along the grooves 24. Thus, some of the polymer can extend past the edge of the aperture 80 to form projections into the grooves. When cured, these projections further increase the bonding of the window to the polishing pad. In addition, if sufficient liquid polymer is provided, then some of the liquid polymer can flow over the top surface of the polishing layer. Again, when cured, the portion of the polymer over the polishing surface can increase the bonding of the window to the polishing pad, although as discussed above the portion of the window 40 projecting above the polishing surface can be removed so that the top of the window is flush with the polishing surface.

While certain embodiments have been described, the invention is not so limited. For example, although a window with a ragged edge is described, the window could be a simpler shape, such as a rectangle or oval. It will be understood that various other modifications may be made without departing from the spirit and scope of the invention. Accordingly, other embodiments are within the scope of the following claims.

What is claimed is:

1. A polishing pad, comprising:

a polishing layer having a polishing surface, an aperture extending entirely through the polishing layer, and a plurality of grooves in the polishing surface that extend partially but not entirely through the polishing layer, the plurality of grooves forming a uniform pattern on the polishing surface, wherein the aperture has edges where side walls of the aperture intersect the polishing surface, wherein the plurality of grooves forming the uniform pattern includes grooves that intersect the aperture and grooves that do not intersect the aperture, and wherein the plurality of grooves are narrower than the aperture; and a solid light-transmitting window filling the aperture and molded to the polishing layer, the window having a top surface coplanar with the polishing surface, and wherein a portion of the window projects laterally past the edges of the aperture into the grooves that intersect the aperture and is molded to the grooves that intersect the aperture.

2. The polishing pad of claim 1, wherein the polishing layer consists of a single layer.

3. The polishing pad of claim 2, wherein the plurality of grooves are about half the depth of the polishing pad.

4. The polishing pad of claim 1, wherein the polishing pad has a total thickness less than 1 mm.

5. The polishing pad of claim 1, wherein the plurality of grooves form a cross-hatched pattern.

6. The polishing pad of claim 1, wherein the plurality of grooves have sloped side walls.

7. The polishing pad of claim 1, wherein the window has a top surface coplanar with the polishing surface.

8. The polishing pad of claim 1, wherein the polishing pad is circular, the aperture extends along a radius of the polishing pad, and the window is longer along the radius than along a direction normal to the radius.

9. The polishing pad of claim 1, wherein the aperture has a vertical side wall, a portion of the vertical side wall extending entirely through the polishing layer.

10. The polishing pad of claim 1, wherein the grooves that intersect the aperture and the grooves that do not intersect the aperture comprise grooves extending in parallel.

* * * * *